United States Patent [19]

Christiansen

[11] Patent Number: 4,964,227

[45] Date of Patent: Oct. 23, 1990

[54] APPARATUS FOR DRYING FINELY DIVIDED SOLIDS

[75] Inventor: Uwe Christiansen, Gelnhausen, Fed. Rep. of Germany

[73] Assignee: Heraeus Quarzschmelze GmbH, Hanau, Fed. Rep. of Germany

[21] Appl. No.: 329,726

[22] Filed: Mar. 27, 1989

[51] Int. Cl.[5] ..... F26B 17/12

[52] U.S. Cl. ..... 34/175; 34/39; 34/57 R

[58] Field of Search ..... 34/39, 40, 165, 166, 34/4, 175, 57 R, 57 A, 57 B, 59, 64, 60; 219/388, 306

[56] References Cited

U.S. PATENT DOCUMENTS

| | | | |
|---|---|---|---|
| 9,711 | 5/1881 | Hanna | 34/165 |
| 547,597 | 10/1895 | Brantingham | 34/59 |
| 2,677,195 | 5/1954 | Menning | 34/4 |
| 4,201,695 | 5/1980 | Juntgen et al. | 34/165 |
| 4,594,795 | 7/1986 | Stephansen | 34/41 |

*Primary Examiner*—Henry A. Bennet
*Assistant Examiner*—John Sollecito
*Attorney, Agent, or Firm*—Felfe & Lynch

[57] ABSTRACT

A vertical drying chamber, for the continuous drying of finely divided solids at temperatures in the range of 800° to 1000° C. by the evaporation of moisture adhering thereto, is formed by the interstice between an inner tube and an outer tube. The outer tube is surrounded by a heat source (electrical resistance heating, infrared radiator) and is composed of a plurality of tube sections plugged one into the other, each tube having a funnel-shaped upper end into which the bottom, plain end of the tube section above it extends. Between the interconnected tube ends spacers are provided. The tube sections are made of a material that is permeable to infrared radiation.

12 Claims, 1 Drawing Sheet

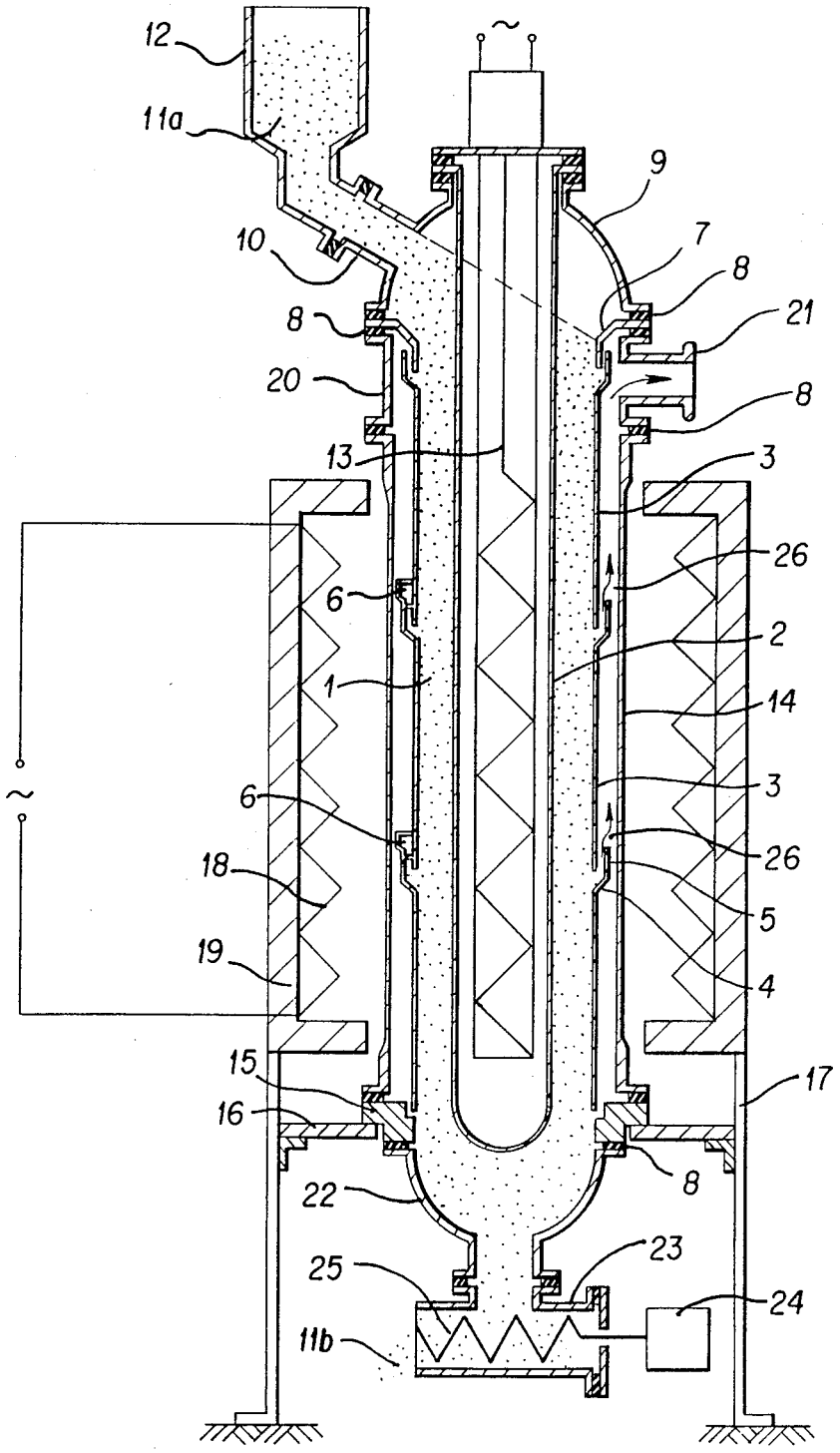
12
11a
10
8
20
13
6
1
6
18
19
15
16
22
25
11b
9
7
8
21
8
3
26
2
14
3
26
5
4
17
8
23
24

APPARATUS FOR DRYING FINELY DIVIDED SOLIDS

BACKGROUND OF THE INVENTION

The invention relates to an apparatus for the continuous drying of finely divided solids by evaporating the moisture adhering thereto.

Apparatus of the kind specified are disclosed in Swiss Patent No. 343,887. They have a vertical drying chamber between an inner tube and an outer tube. A connection for feeding moist solids leads into the upper end of the drying chamber, at whose bottom end there is provided a hopper for the discharge of dried solids. The outer tube is surrounded by a heating jacket through which a heat medium flows and directly heats the wall of the outer tube. By heating the outer tube wall, heat is supplied continuously to the moist solid during the drying process. The dried solids are caught in a container. Preheated clean gas fed into the moist solids to suspend them escapes through the inner tube. Separation of the dried solid from the gas is performed in a centrifugal air separator.

DE-PS No. 1 085 751 discloses an apparatus for drying wheat, in which the wheat to be dried is sprinkled onto surfaces inclined from the horizontal and disposed one following the other, and is thus exposed to the action of infrared radiators.

In the drying of finely divided solids which become thermal insulators as they are dried, considerable problems are involved in thermal transfer, because, as long as their content of adherent moisture is still high, such solids can be dried well, but as the dryness increases their thermal insulating properties become increasingly apparent, until the drying process finally comes to a halt.

SUMMARY OF THE INVENTION

The object of the invention is to provide an apparatus for drying, at temperatures above 700° C., preferably in the range from 800° to 1000° C., finely divided solids which are made thermally insulating by drying, such as, for example, moist, granulated silicon dioxide.

Apparatus for the continuous drying of finely divided solids by evaporating adherent moisture, has a vertical drying chamber between an inner tube and an outer tube. A connection for feeding moist solids is provided on the upper end of the chamber, a hopper for discharging moist solids is provided on the bottom of the chamber, and a heating source envelopes the outer tube. The outer tube is formed from a plurality of tube sections plugged one into the other and made of material permeable to infrared radiation, the upper end of each tube section being in the form of a funnel surmounted by a collar and the bottom end being plain, and at each bottom end of a tube section extending into the upper end of another tube section a spacer is fastened, and the heat source in the form of an electrical resistance heater or of infrared radiators is disposed at a distance from the outer tube. In these apparatus it is advantageous that the inner tube is closed at one end, consists of material permeable to infrared radiation, and contains an additional heat source in the form of an electrical resistance heater or of an infrared radiator, resulting in a more intense drying action for shorter periods of time.

The outer tube is best enveloped at a distance by a protective tube of material transparent to infrared radiation. This will assure that the released vapor will not have a harmful effect on the heat source. Particularly where acid vapors are involved, the space between the outer tube and the protective tube is connected to a vapor exhaust connector through which such acid vapors can be aspirated. Vapors formed during the drying of the moist solids are exhausted through the interstice formed by the plugging together of the ends of the outer tube. At the same time the spacer between the two tube ends is advantageously in the form of an annular body provided with openings to allow the vapors to pass through. Spacers have also proven desirable which consist of a plurality of chocks arranged in a circle and spaced apart from one another.

In order to assure the best possible drying action, it has been found desirable for the inner tube, the outer tube and the protective tube to consist of transparent vitreous silica, at least in the heated zones. This has the additional advantage that acid vapors can remain on the components of the apparatus without doing any harm. All the rest of the components can best consist of opaque fused silica for reasons of purity.

In apparatus in accordance with the invention, the width of the drying chamber is 5 to 10 cm, preferably 5.5 to 6.5 cm, which will assure that the drying of moist solids which when dry become excellent thermal insulators can be performed in industrially acceptable time and in suitable amounts.

To achieve continuous drying, the dried solids must be continuously removed, and conveying means in the form of a roller, a screw or a vibrating chute are connected to the dry solids discharge hopper for that purpose.

BRIEF DESCRIPTION OF THE DRAWING

The sole FIGURE is a diagrammatic vertical section of the apparatus.

DETAILED DESCRIPTION OF THE PREFERRED EMBODIMENT

The vertical drying chamber 1 is formed by the inner tube 2, which is closed at one end, and the outer tube which consists of a plurality of tube sections 3 plugged one into the other. Each such tube section 3 is configured at one end in the shape of a hopper 4 surmounted by a collar 5. Into the end, thus formed, of a tube section 3 extends the plain end of the tube section disposed above it. On the plain end of each tube section 3 there are fastened a plurality of spacers 6. In the embodiment they are spacing chocks. A plurality of such chocks are arranged in a circle on the circumference of the bottom end of the tube section at intervals apart, in a circle. Into the upper end of the topmost tube section 3 extends a feed hopper 7 on which a bell 9 is mounted with gaskets 8; this bell is provided with the connection 10 for feeding the moist granules 11*a* which are in a feed hopper 12. An additional heat source 13, such as a resistance heater, extends into the inner tube 2 and is connectable to an electric power source.

The outer tube formed of a plurality of tube sections 3 is surrounded at a distance by a protective tube 14. The protective tube 14 rests at the bottom end on a ring 15 which is supported by a steel plate 16 on the support 17. The support 17 rests on the floor at one end, and at the other end it supports an oven comletely enveloping the drying chamber; the oven has a resistance heater 18 which is shielded externally by the insulator 19. At the upper end the protective tube 14 is sealed tightly by gaskets 8 and by an intermediate ring 20 to the feed hopper 7 and the bell 9. On the intermediate ring 20 is the vapor exhaust connection 21. At the bottom end is a discharge hopper 22 fastened to the ring 15 with gaskets 8. The conveyor 23 for the dried granules **11*b* is connected to the discharge hopper 22. In the embodiment the conveyor 23 consists of a screw 25 driven by a motor 24**.

The operation of the apparatus is as follows:

Moist granules **11*a* pass from the feed hopper 2 through the connection 10 into the drying chamber 1 whose width amounts to about 5.5 to 6.5 cm. In the drying chamber it is heated both by the resistance heater 18 and by the additional heat source 13. The vapors that form can, as indicated by the arrows 26, escape into the space between the outer tube and the protective tube, through the funnel-like ends of the tube sections 3, and they are carried away through the connection 21. The moist granules 11*a* fall downward during the drying process, and the throughput of the granules being dried is determined by the discharge from the conveyor which dispenses the dried granules 11*b*** in a measured manner.

The components situated near the heated zones consist advantageously of a material that is transparent to infrared radiation, preferably transparent fused silica (quartz glass). For the rest of the parts of the apparatus, such as the feed hopper 7, bell 9, feed connection 10, ring 15, intermediate ring 20, vapor exhaust connection 21 and discharge hopper 22, opaque fused quartz is used, for example. The use of these materials has the advantage that even moist granules which contain acid can be dried, without the need to fear damage to the components of the apparatus.

I claim:

1. Apparatus for the continuous drying of finely divided solids by the evaporation of moisture adhering thereto, which has a vertical drying chamber between an inner tube and an outer tube, to the upper end of which a connection for feeding moist solids leads, and at the lower end of which a hopper for the discharge of dried solids is provided, and which has a heat source surrounding the outer tube, characterized in that the outer tube is composed of a plurality of tube sections (3) of a material permeable to infrared radiation, received one into the other, the upper end of each tube section (3) being in the shape of a funnel (4) surmounted by a collar (5) and the bottom end being plain, and on each bottom end of a tube section extending into an upper end of a tube section a spacer (6) is fastened, and that the heat source, in the form of infrared radiation means, is disposed at a distance from the outer tube.

2. Apparatus in accordance with claim 1, characterized in that the inner tube (2) is closed at one end, consists of material permeable to infrared radiation, and contains an additional heat source (13) in the form of a electrical resistance heater or of an infrared radiator.

3. Apparatus in accordance with claim 1, characterized in that the outer tube is enveloped at a distance by a protective tube (14) of material permeable to infrared radiation.

4. Apparatus in accordance with claim 3, characterized in that a vapor exhaust connection (21) is in communication with the chamber between outside tube and protective tube (14).

5. Apparatus in accordance with claim 1, characterized in that the spacer (6) consists of an annular body with openings for the passage of vapors.

6. Apparatus in accordance with claim 1, characterized in that the spacer (6) consists of a plurality of spacer chocks arranged in a circle and spaced apart from one another.

7. Apparatus in accordance with claim 3, characterized in that the radiation permeable material of the inner tube (2), the outer tube and the protective tube (14) comprises transparent fused silica, at least in the area of the heated zones.

8. Apparatus in accordance with claim 1, characterized in that the distance between the outer surface of the inner tube and the inner surface of the outer tube amounts to 5 to 10 cm.

9. Apparatus in accordance with claim 8, characterized in that the distance between inner tube and outer tube amounts to 5.5 to 6.5 cm.

10. Apparatus in accordance with claim 1, characterized in that the discharge hopper (22) is connected, for the continuous, measured removal of the dried solids, with a conveyor means (23) in the form of a roller, a screw (25) or a shaker table.

11. Apparatus for the continuous drying of finely divided solids by the evaporation of moisture adhering thereto, comprising an inner tube comprising a material permeable to infrared radiation, infrared radiating means inside said inner tube, an outer tube concentric to said inner tube to form a vertical drying chamber therebetween, said outer tube comprising a plurality of tube sections comprising a material permeable to infrared radiation, each tube section having a funnel-like upper end and a lower end, said lower end being received in the upper end of an adjacent tube section and spaced therefrom, infrared radiating means spaced externally of said outer tube, means for feeding said finely divided solids into the upper end of said vertical drying chamber, and hopper means for receiving finely divided solids at the bottom end of said vertical drying chamber.

12. Apparatus as in claim 11 further comprising a protective tube concentric to said outer tube to form a vapor collecting chamber therebetween, said protective tube comprising a material permeable to infrared radiation and being located between said outer tube and said infrared radiating means externally thereof, and vapor exhaust means for exhausting vapor from said vapor collecting chamber.

* * * * *